US007503842B2

(12) United States Patent
Lee et al.

(10) Patent No.: US 7,503,842 B2
(45) Date of Patent: Mar. 17, 2009

(54) AIR CURTAIN-ASSISTED EXHAUST METHOD AND DEVICE THEREOF

(75) Inventors: Shuei-Yuan Lee, Taipei (TW); Pei-Hsin Pei, Taipei (TW); Shun-Chih Wang, Taipei County (TW); Cheng-Ping Chang, Taipei (TW); Tung-Sheng Shih, Sijhih (TW)

(73) Assignee: Acxing Industrial Co., Ltd., Taipei (TW)

( * ) Notice: Subject to any disclaimer, the term of this patent is extended or adjusted under 35 U.S.C. 154(b) by 117 days.

(21) Appl. No.: 11/601,286

(22) Filed: Nov. 17, 2006

(65) Prior Publication Data

US 2007/0113839 A1 May 24, 2007

(30) Foreign Application Priority Data

Nov. 21, 2005 (TW) ..... 94140844 A

(51) Int. Cl.
*F24C 15/20* (2006.01)
*F24F 9/00* (2006.01)
*B08B 15/02* (2006.01)

(52) U.S. Cl. ..... 454/66; 454/67; 454/188; 454/191; 454/192; 126/299 D

(58) Field of Classification Search ..... 454/56, 454/66, 67, 188, 189, 192, 191; 126/299 D
See application file for complete search history.

(56) References Cited

U.S. PATENT DOCUMENTS

| | | | | |
|---|---|---|---|---|
| 2,014,962 | A * | 9/1935 | Bramsen | 454/51 |
| 3,292,525 | A * | 12/1966 | Jensen | 126/299 D |
| 3,303,839 | A * | 2/1967 | Tavan | 126/299 D |
| 4,047,519 | A * | 9/1977 | Nett | 126/299 D |
| 4,143,645 | A * | 3/1979 | Blumberg | 126/299 D |
| 4,788,905 | A | 12/1988 | Von Kohorn | |
| 5,042,456 | A | 8/1991 | Cote | |
| 6,450,879 | B1 | 9/2002 | Suen | |
| 6,634,411 | B2 * | 10/2003 | Hirano et al. | 164/72 |
| 6,752,144 | B1 | 6/2004 | Lee | |

FOREIGN PATENT DOCUMENTS

EP 118570 A2 * 9/1984

(Continued)

*Primary Examiner*—Steven B McAllister
*Assistant Examiner*—Patrick F. O'Reilly, III
(74) *Attorney, Agent, or Firm*—Morris Manning Martin LLP; Tim Tingkang Xia, Esq.

(57) ABSTRACT

An air curtain-assisted exhaust method and a device thereof are provided. Air curtain generators are disposed on a worktable to enclose an encircled area in the worktable. A receiving hood is disposed above the worktable, wherein the vertical lower part of the outer edge of the receiving hood completely covers the encircled area. Then, the air curtain generators are started to blow out air curtains toward an opening of the receiving hood, and the receiving hood is started to suck an air flow. A shielding space is defined by the air flow sucked by the receiving hood and the air curtains, so that the air curtains may guide a smoke generated inside the shielding space to the receiving hood to be exhausted, thereby achieving the effect of auxiliary exhaust, and may restrict the smoke in the shielding space to prevent the smoke from diffusing laterally.

6 Claims, 5 Drawing Sheets

FOREIGN PATENT DOCUMENTS

| | | | | |
|---|---|---|---|---|
| JP | 57157945 | A | * | 9/1982 |
| JP | 01114649 | A | * | 5/1989 |
| JP | 05071784 | A | * | 3/1993 |
| JP | 2004309101 | A | * | 11/2004 |
| KR | WO 9822755 | A | * | 5/1998 |

* cited by examiner

AIR CURTAIN-ASSISTED EXHAUST METHOD AND DEVICE THEREOF

CROSS-REFERENCE TO RELATED APPLICATIONS

This non-provisional application claims priority under 35 U.S.C. § 119(a) on Patent Application No(s). 094140844 filed in Taiwan, R.O.C. on Nov. 21, 2005, the entire contents of which are hereby incorporated by reference.

BACKGROUND OF THE INVENTION

1. Field of Invention

The present invention relates to a hood exhaust method and a device thereof, and more particularly, to an air curtain-assisted exhaust method and a device thereof.

2. Related Art

Currently, in workplaces where fumes, dust, or chemical vapors present a hazard, local exhaust ventilation devices are used to prevent workers from inhaling contaminated air. Generally, an exterior exhaust hood, for example, a receiving hood, is disposed above the emission source to remove airborne contaminants. However, theoretical capture efficiency of such a receiving hood holds only in still air, the capture efficiency decreases due to crosswind in the surrounding environment, no matter how weak the crosswind is. To control the adverse effect of crosswind, a fume hood having a back panel, two side panels, and a hood sash in the front has been designed to replace a receiving hood. However, the side panels and hood sash of a fume hood limit the size of operation space for operators' upper limbs. Therefore, how to eliminate the adverse effect of crosswind, and meanwhile retain the freedom of operators' upper limbs, becomes a key topic to a receiving hood.

In order to accomplish the key topic, U.S. Pat. No. 4,788,905, published on Dec. 6, 1988, disclosed a combination cooking, eating and ventilating system. The system contains an open fire grill surrounded by an unperforated griddle, both of which are surrounded by an eating counter. A fan is positioned below the cooking grill and griddle which forces the air upward between the eating counter and the griddle in the shape of an air curtain for removing hot smoking air from the cooking area. However, due to the limited size, the fan is not applicable in a large-scale worktable. Further, generally speaking, there is not necessarily enough space to accommodate the fan device below the worktable.

Moreover, U.S. Pat. No. 5,042,456, published on Aug. 27, 1991, disclosed an air canopy ventilation system. The system comprises a surface having two substantially parallel spaced apart side panels surmounted at their respective upper edges by a canopy. A vent means having a plurality of outlets extends between the side panels and substantially the whole length of the front edge of the surface. A fan means connected to the vent means is adapted to drive a flow of air through the vent means upwardly to form a curtain of air over the front of the system, thereby entraining within the area fumes and odors. The upwardly flowing air, fumes and odors are removed by an exhaust means. Though the system can solve the problem of the lateral diffusion of the smoke and the influence of the crosswind, the air flow perpendicular to the side panel affects the efficiencies of the upward air curtain and canopy. Meanwhile, the structure of the system having the side panel and back panel limits the size of the operation space in which the operator can operate.

Further, U.S. Pat. No. 6,450,879, published on Sep. 17, 2002, disclosed an air curtain generator including a casing with a fan received therein so as to blow an air curtain from the opening of the casing, and the air curtain separates the workers and the source which generates contaminated air. However, the air curtain only isolates the smoke from laterally diffusing towards the operator, but does not isolate the smoke from diffusing towards the side without the air curtain generator. Additionally, the inventor of the present invention disclosed an air curtain generator in U.S. Pat. No. 6,752,144 published on Jun. 22, 2004, and the present invention is a continued invention along the lines of this patent.

SUMMARY OF THE INVENTION

According to one aspect of the invention, a method is provided for exhausting smoke. The method of the present invention includes the following steps. Air curtain generators are disposed and arranged to enclose an encircled area in the worktable. The encircled area is smaller than that of the opening of the receiving hood. Each air curtain generator is started to blow out an air curtain with an air blow speed, wherein the air blow speed is calculated simply by calculating the air blow direction and air blow rate. Each air curtain is blown to the opening of the receiving hood and the receiving hood is started to suck the exhaust air flow; therefore, the air curtain generator may generate air current which carries the smoke toward the receiving hood, by which the mixture of smoke and air curtain flow is exhausted.

According to another aspect of the invention, a device is provided for exhausting smoke. The device of the present invention is disposed on the worktable and includes a receiving hood and air curtain generators. The receiving hood is disposed above the worktable, and the air curtain generators are disposed on the outer edge of the worktable. Each air curtain generator blows out an air curtain towards the opening of the receiving hood, so that the air curtains, the worktable, and the receiving hood together enclose a shielding space, wherein the air curtains are used to improve the capture efficiency of the receiving hood.

Accordingly, it is an object of the present invention to provide an air curtain-assisted exhaust method and a device thereof, so as to solve the problems existing in the prior art.

Further, the present invention may implement the method and dispose the device with a worktable surrounded at least by a wall. Under this condition, the method of disposing an air curtain generator is to enclose an encircled area in the worktable that matches up with the wall, wherein the encircled area is smaller than that of the opening of the receiving hood. Additionally, as for the device, the air curtain generator is only desired to be disposed on the side of the worktable without being surrounded by the wall, so that the air curtain generators together with the walls and the receiving hood may enclose a shielding space.

When smoke is generated in the shielding space, air curtains trap the smoke and carry it to the opening of the receiving hood, thus improving the capture efficiency of the receiving hood. Meanwhile, since an air curtain is a high-speed jet, and crosswind in the surrounding environment is often much weaker than the jet of air curtain, adverse effect of crosswind can be reduced.

In other words, inward and downward vortices generated by air curtains under a dividing height may block and trap the smoke, and then pushes it toward opening of the receiving hood, so that larger particles in the smoke may adhere to the table surface and the rest of the particles which flow into the air curtain are lifted up to the opening of the receiving hood. With the present invention, the smoke generated in the shielding space is guided to the receiving hood to be exhausted, thus effectively preventing the smoke from diffusing laterally.

For instance, when there is a wall against the back of the worktable, the air curtain generators on left and right sides of the worktable blow air jets respectively toward the opening of the receiving hood. The two side air jets generate symmetrical vortices. In addition, the air curtain on the front of the worktable blows an air jet and generates another vortex. Therefore, once smoke is generated, some of the particles in the smoke will be forced by the three vortices to deposit on surfaces of worktable and back wall, and the rest of the particles will be exhausted by the receiving hood.

The detailed features and advantages of the present invention will become apparent from the detailed description given hereinafter, and the content is sufficient for any skilled in the art to comprehend the technical content of the present invention and implement accordingly. Any skilled in the art can easily understand the related objects and advantages of the present invention from the disclosure, claims and drawings.

BRIEF DESCRIPTION OF THE DRAWINGS

The present invention will become fully understood from the detailed description given herein below for illustration only, and which thus is not limitative of the present invention, and wherein.

DETAILED DESCRIPTION OF THE INVENTION

In order to make the objects, structure, features, and functions of the present invention more comprehensible, preferred embodiments are described in detail below. The above illustration related to the content of the present invention and the detailed description are used to exemplary and explain the principle of the present invention, and provide a further explanation of the claim of the present invention.

Figure 1:
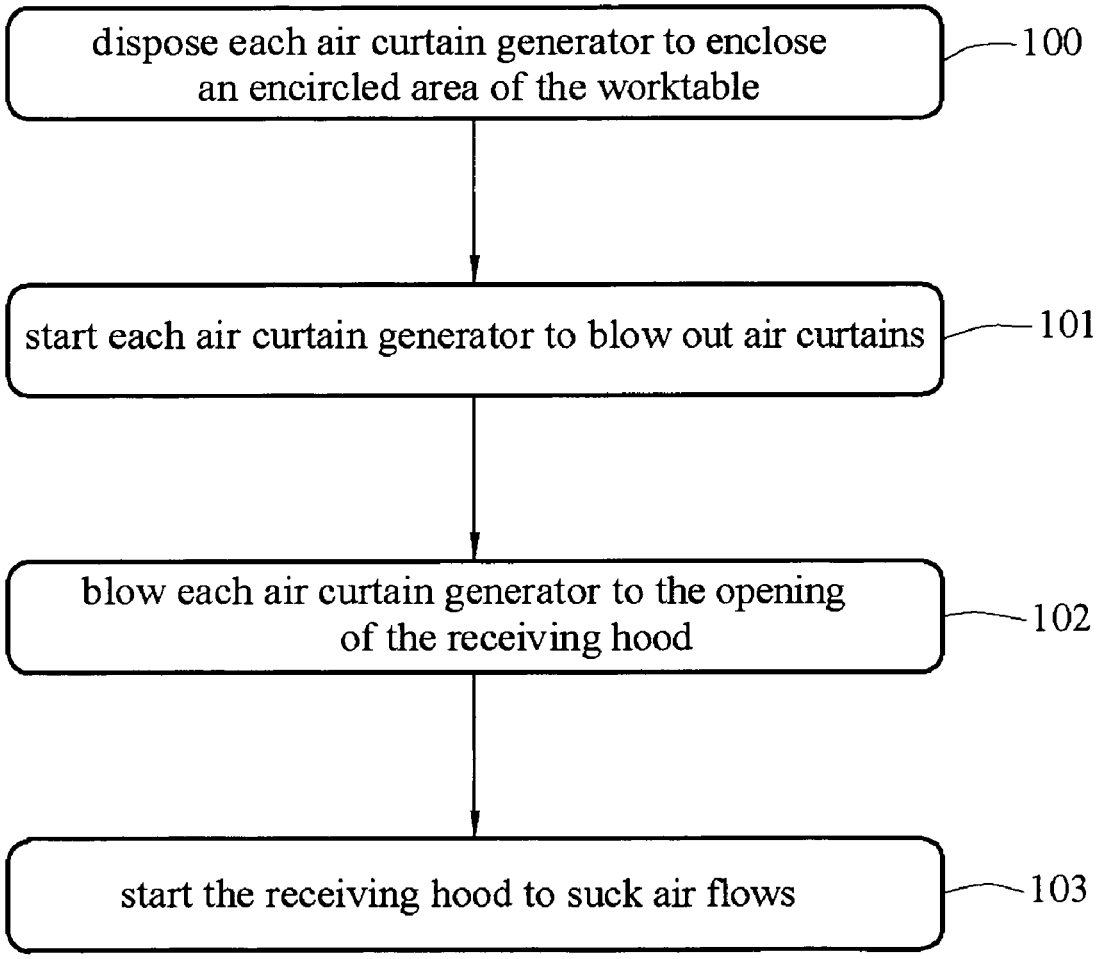
FIG. 1 is a flow chart of the method according to the present invention.

Referring to FIG. 1, it is a flow chart of the steps of the air curtain-assisted exhaust method of the present invention. As shown in the figure, each air curtain generator is disposed to enclose an encircled area in the worktable (step 100), wherein the encircled area is made to be smaller than that of the opening of the receiving hood. Then, each air curtain generator is started to blow out an air curtain having an air blow speed, which is determined by the blowing force of the air curtain generator and comprised of an air blow direction and an air blow rate (step 101). Next, air curtains flow toward opening of the receiving hood (step 102), wherein the encircled area is smaller than that of the opening of the receiving hood, and the vertical component of the air blow direction directs to the opening of the receiving hood. The receiving hood is started to suck the exhaust-air flow of the air curtains (step 103). The exhaust rate is determined by the suction force of the receiving hood and gradually decreases as the air flow is gradually far away from the receiving hood, and the exhaust rate at the opening of the receiving hood is larger than the summation of all air blow rates of all air curtains, wherein the exhaust-air flow and each air curtain define a shielding space. Moreover, in the shielding space, a dividing height is formed at the zone where the lifting force of the air curtain and the suction force of the receiving hood are in a balanced state, wherein the balanced state refers to that the lifting force of the air curtain is too weak to lift the air flow and that the suction force of the receiving hood is too weak to suction the air flow. Thus, the shearing stress generated by the air curtain beneath the dividing height forms inward and downward vortices. The air flow has almost no trend to lift or drop in the vertical quiet zone.

Further, the present invention may implement the method with the worktable surrounded at least by a wall. Under this condition, the method of disposing air curtain generator is to enclose an encircled area in the worktable that matches up with the wall, wherein the encircled area is made to be smaller than that of the opening of the receiving hood. Also, at the moment, the shearing stress generated by the air curtain under the dividing height forms an inward and downward vortex together with the blocking effect of the wall.

Figure 2:
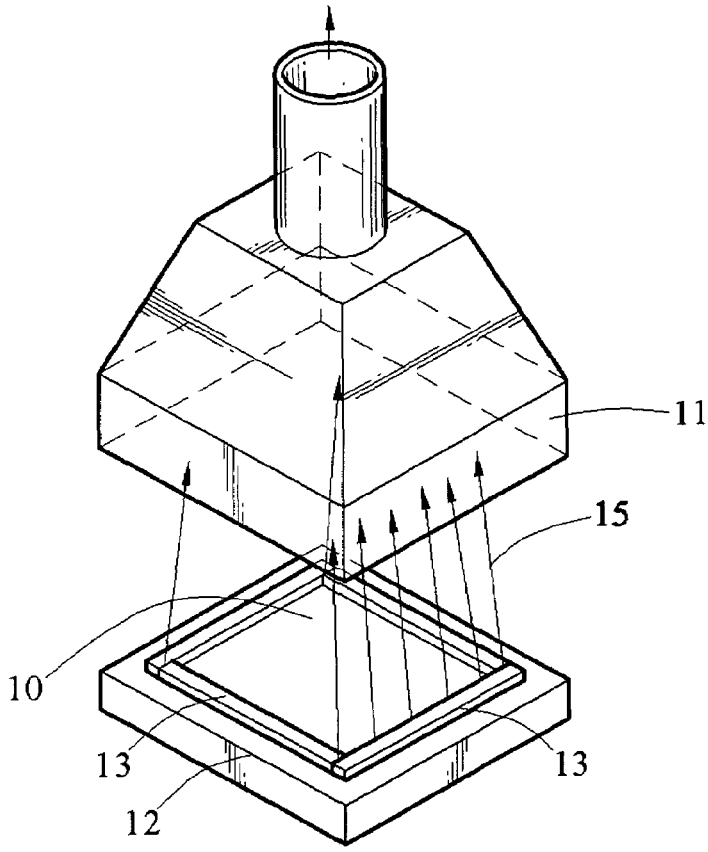
FIG. 2 is an architecture view of the device according to the present invention.

Referring to FIG. 2, it is an architectural view of the device of the present invention. As shown in the figure, the device is disposed on an open worktable 12 and includes a receiving hood 11 disposed above the worktable 12 and a plurality of air curtain generators 13 disposed on the outer edge of the worktable 12. Each air curtain generator 13 blows out an air curtain 15 towards the opening of the receiving hood 11, and the air curtains 15 may form an air wall (only one air wall formed by the air curtain 15 on one air curtain generator 13 is shown in the figure as a representative), such that the air curtains blown out by air curtain generators 13, the worktable 12, and the receiving hood 11 together enclose a shielding space 10, so as to improve the capture efficiency of the receiving hood 11 with such device. Moreover, the device of the present invention can be disposed with the worktable 12 surrounded at least by a wall (not shown). Under this condition, the air curtain generators 13 are disposed on the side of the worktable 12 which is not surrounded by the wall, such that the air curtains blown out by the air curtain generators 13, the wall, the worktable 12, and the receiving hood 11 together enclose a shielding space, thus also improving the capture efficiency of the receiving hood 11. The receiving hood 11 can be a kitchen exhauster in a kitchen or an exterior exhaust hood in a laboratory or factory. The air curtain generators 13 may be connected with one another to form a multi-piece structure. As shown in the figure, four air curtain generators 13 connected with one another are disposed on the open rectangular worktable 12; if one side of the worktable 12 is against a wall, three air curtain generators 13 are disposed accordingly; if the worktable 12 is surrounded by two walls, two air curtain generators 13 are disposed accordingly; and if the worktable 12 is surrounded by three walls, one air curtain generator 13 is disposed accordingly; if the worktable 12 is not surrounded by walls, four air curtain generators 13 are disposed accordingly.

Figure 3:
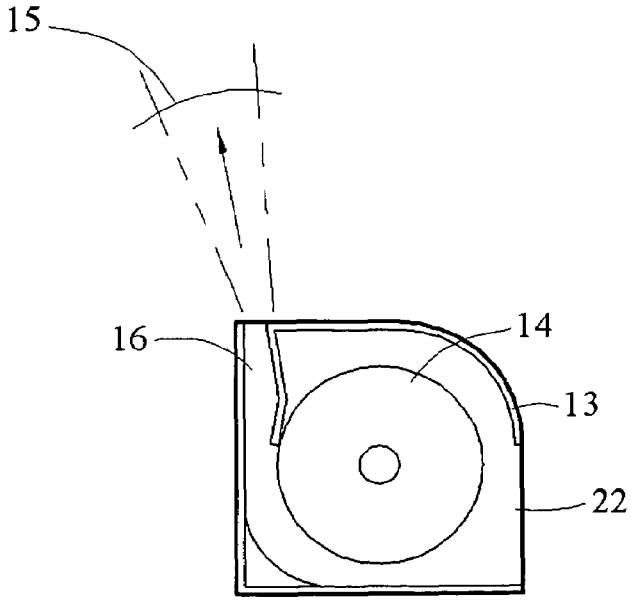
FIG. 3 is a sectional view of the air curtain generator according to the present invention.

The structure of the air curtain generator 13 is described in detail by referring to FIG. 3, which is a sectional view of the air curtain generator 13, wherein the air curtain generator 13 includes an upward air outlet 16, an air inlet 22, and a squirrel cage fan 14. When the squirrel cage fan 14 rotates, an external air flow is driven to enter the air curtain generator 13 through the air inlet 22, and passes through the upward air outlet 16 to form an air curtain 15. The angle of the air curtain 15 blown out by the upward air outlet 16 falls in 5 to 10 degrees. Moreover, the air curtain generator 13 can also be replaced with a blower, i.e., the squirrel cage fan 14 can be replaced with an air duct which is connected with a blower, wherein the air flow is blown out by the air blower, passes through the air duct, enters the air curtain generator 13, and then is exhausted from the upward air outlet 16 to form the air curtain 15.

Figure 4A:
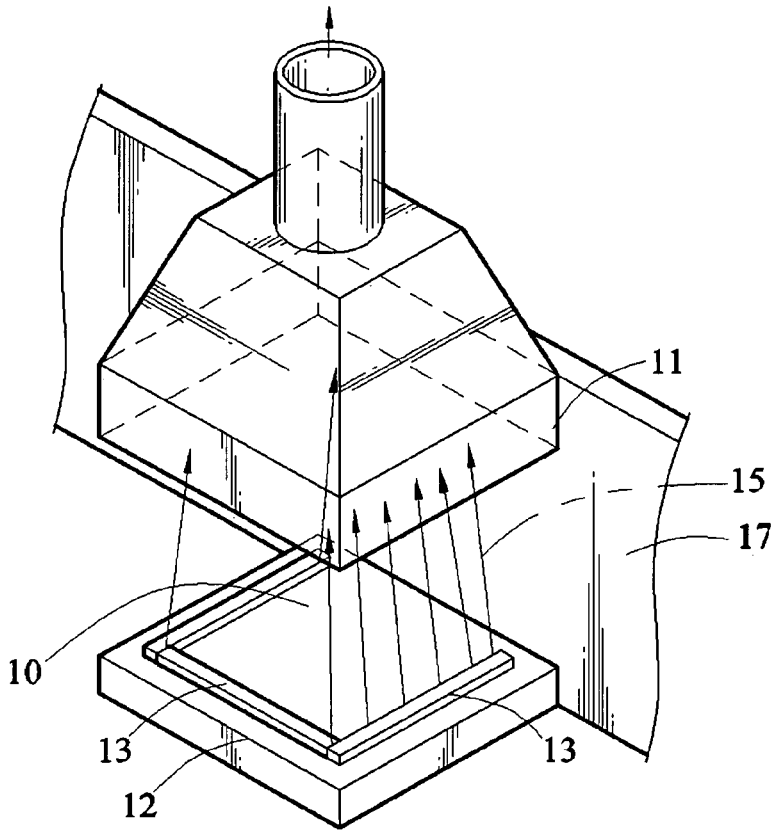
FIGS. 4A and 4B are views of a first embodiment according to the present invention.
Figure 4B:
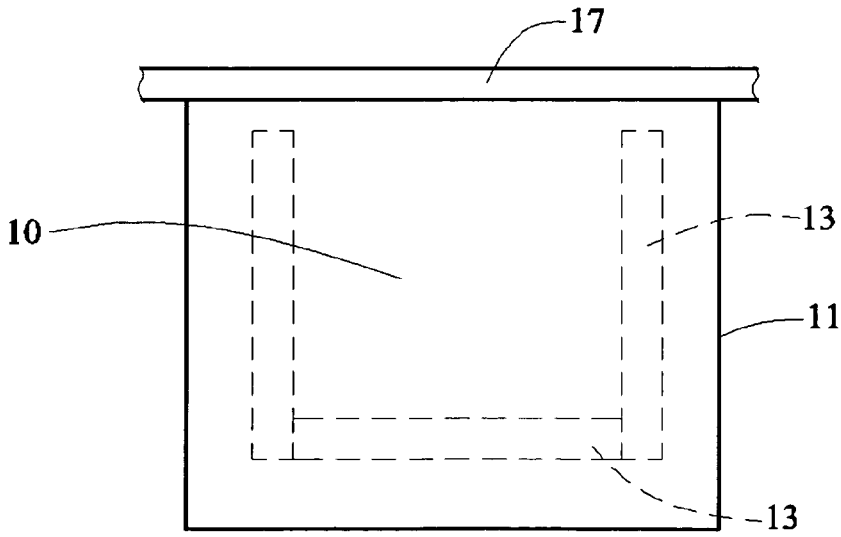

The air curtain-assisted exhaust method and device thereof can be further illustrated with a first embodiment. Referring to FIGS. 4A and 4B together, they show the device in the first embodiment. As shown in the figures, the receiving hood 11 is disposed above the worktable 12, and one side of the worktable 12 is against a wall 17, and the air curtain generators 13 are disposed on the sides of the worktable 12 which are not surrounded by the wall 17, as shown in FIG. 4A. FIG. 4B is a top view of the device. As shown in the figure, the ratio between the encircled area in the worktable enclosed by the air curtain generators 13 together with the wall 17 and the area of the opening of the receiving hood 11 is 0.8:1, wherein the ratio is a ratio by which the device may provide optimum effect when the distance between the air curtain generators 13 and receiving hood 11 is equal to about half of the height of the operator. The air curtain generators 13 are started to blow out the air curtains 15 toward the opening of the receiving hood 11, and the air blow speed of the air curtains 15 gradually decreases as they are far away from the air curtain generators 13. When the air curtains 15 are blown to the opening of the receiving hood 11, their encircled area is smaller than that of the opening of the receiving hood 11.

As shown in FIG. 4A, the air curtain 15 presents a convergent orientation from the air curtain generator 13 towards the receiving hood 11, such that the vertical components (not shown) of the air blow direction of the air curtain 15 all direct to the opening of the receiving hood 11, and the horizontal components (not shown) of the air blow direction all direct to the interior of the shielding space 10. The receiving hood 11 is started to suck the air flow and then exhaust it. The rate of the exhaust air flow is determined by the suction force of the receiving hood 11, wherein the farther the air flow is from the opening of the receiving hood 11, the weaker the suction force is, such that the sucked air flow also has a smaller exhaust rate. The exhaust rate at the opening of the receiving hood 11 is controlled to be larger than the air blow speed of the air curtain 15 blown to the receiving hood 11, so that the blowing effect of the air curtain 15 is not in conflict with the suction effect of the receiving hood 11.

Figure 5A:
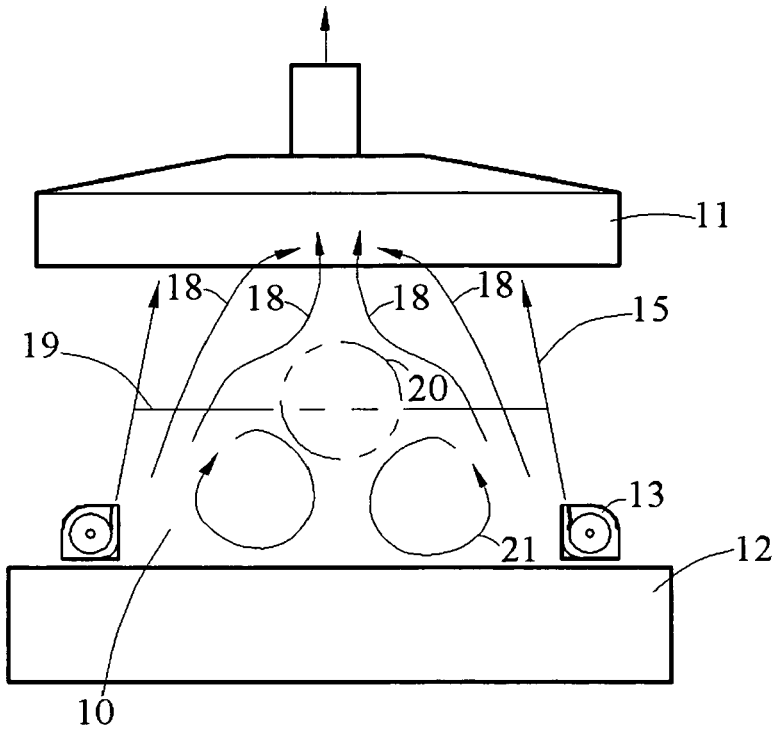
FIGS. 5A and 5B are sectional views of the air flow field according to the first embodiment of the present invention.

An air flow field formed in the first embodiment is illustrated herein below. Referring to FIG. 5A, it is a sectional view of the air flow field formed when two opposite sides of the worktable 12 are both disposed with the air curtain generators 13. The blowing effect of the air curtain 15 and the suction effect of the receiving hood 11 result in a lifting air flow 18, and when a smoke (not shown) is generated in the shielding space 10, the lifting air flow 18 guides the smoke into the receiving hood 11 to be exhausted. A vertical quiet zone 20 is formed at a dividing height 19, and in the vertical quiet zone 20, the air flow neither lifts up nor drops down due to insufficient lifting force. Therefore, larger particles in the vertical quiet zone 20 drop down due to Earth's gravity, i.e., enter the inward and downward vortices 21. The inward and downward vortices 21 firstly block and trap the smoke, and then push it toward the surface of the worktable 12, so that the larger particles in the smoke deposit and adhere to the surface of the worktable 12, and then the rest of the smoke is pushed towards the air curtain 15 by the inward and downward vortices 21 to enter the lifting air flow 18, thus being lifted to the receiving hood 11 to be exhausted. Therefore, the air flow field formed by the shielding space 10 efficiently guides the smoke in the worktable 12 to be exhausted by the receiving hood 11, or makes the larger particles adhere to the surface of the worktable 12 due to the gravity, thus avoiding the leakage of the smoke and improving the capture efficiency of the receiving hood 11.

Figure 5B:
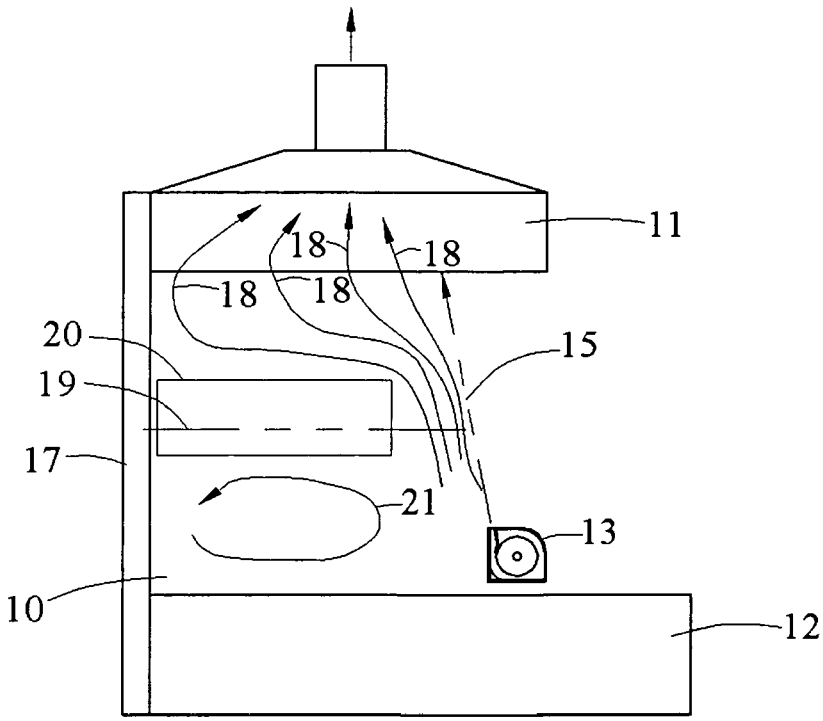

Next, referring to FIG. 5B, it is a sectional view of an air flow field formed when the air curtain generator 13 is disposed on the worktable 12 opposite to the wall 17. As shown in the figure, the blowing effect of the air curtain 15 and the suction effect of the receiving hood 11 result in a lifting air flow 18, which can guide a smoke (not shown) to enter the receiving hood 11 to be exhausted when the smoke is generated in the shielding space 10. The vertical quiet zone 20 is formed at the dividing height 19 close to the wall 17, and in the vertical quiet zone 20, the air flow neither lifts up nor drops down due to insufficient lifting force. Therefore, the smoke in the quiet zone easily generates the effect of particle coagulation. When being big enough to drop down under the gravity, the particles enter the inward and downward vortices 21. The inward and downward vortices 21 firstly block and trap the smoke, and then push it towards the top surface of the worktable 12 close to the wall 17, so that the coagulated particles in the smoke drop down and adhere to the surface of the worktable 12 due to the gravity, and the rest of the smoke is pushed towards the air curtain 15 by the inward and downward vortices 21 to enter the lifting air flow 18, thus being lifted to the receiving hood 11 to be exhausted. Therefore, the air flow field between the wall 17 and the air curtain 15 efficiently guides the smoke in the worktable 12 to be exhausted by the receiving hood 11, or makes the larger particles adhere to the surface of the worktable 12 due to the gravity, thus avoiding the leakage of the smoke and improving the capture efficiency of the receiving hood 11.

Figure 6:
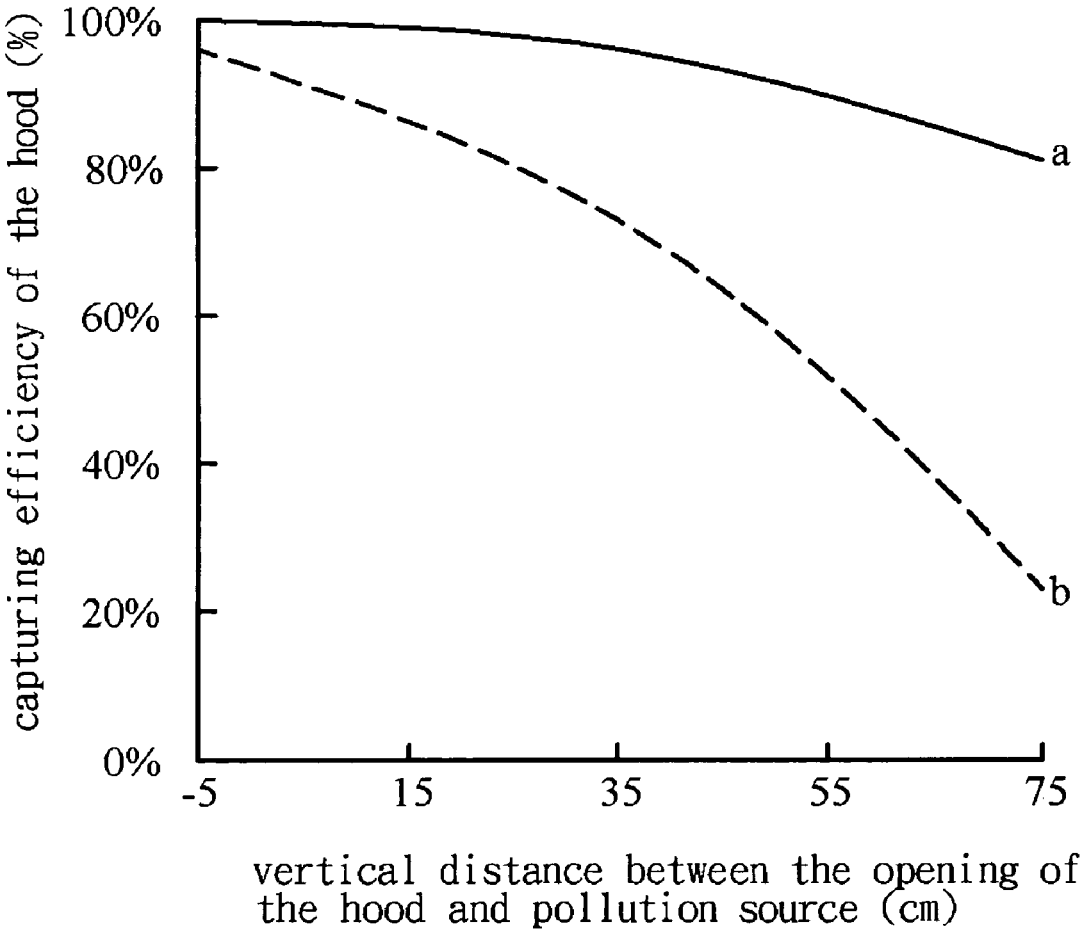
FIG. 6 is an experimental data diagram of the efficiency test of the present invention.

The performance of the present invention is illustrated through the experiment of the first embodiment. In this experiment, a releaser of Sulfur Hexafluoride is placed in the shielding space 10, wherein the distance between the releaser and the worktable 12 is adjusted according to the demands of the experiment, and a gas detector is used to detect the concentration of the Sulfur Hexafluoride contained in the gas sample exhausted from the receiving hood 11. The control group of this experiment detects the concentration of Sulfur Hexafluoride contained in the gas sample exhausted from the started receiving hood 11 when the air curtain generators 13 are not started, while the experimental group of this experiment detects the concentration of Sulfur Hexafluoride contained in the gas sample exhausted from the receiving hood 11 when the air curtain generators 13 and the receiving hood 11 are started simultaneously. In the control group and the experimental group, the vertical distance between the Sulfur Hexafluoride releaser and the worktable 12 is gradually increased during the experiment, and the values of the concentration of Sulfur Hexafluoride detected by the gas detector under different vertical distances are respectively recorded. Other parameters of this experiment include that: the wind speed of the exhaust duct of the receiving hood is 5.0 m/s, the exhaust duct diameter of the receiving hood is 200 millimeters, the exhaust air volume of the receiving hood is 9.42 $m^3$/min, and the release flow rate of Sulfur Hexafluoride is 59.5 ml/min. FIG. 6 shows the result of this experiment. The transverse axis in the figure represents the vertical distance between the opening of the receiving hood and the Sulfur Hexafluoride releaser, wherein the unit is centimeter, and negative value represents that the releaser extrudes into the opening of the receiving hood, and the longitudinal axis represents the capture efficiency of the receiving hood obtained after the calculation of the values of concentrations of Sulfur Hexafluoride detected by the detector. "a" is the experimental data of the experimental group, and "b" is the experimental data of the control group. It can be known that the capture efficiency improved with the air curtains falls in 81% to 100%, wherein the capture efficiency is 81% when the Sulfur Hexafluoride releaser is placed on the tabletop of the worktable, and the capture efficiency is 100% when the Sulfur Hexafluoride releaser is placed at the opening of the receiving hood, while the capture efficiency without the assistance of the air curtains falls in 23% to 96%, and the differential multiple between the two falls in 1.0 to 3.5. In other words, when the smoke is near to the tabletop of the worktable, the air curtain-assisted receiving hood can improve the capture efficiency by more than 3 three times.

To sum up, in the present invention, when the air flow field as shown in FIG. 5A or FIG. 5B can be generated, the shielding space defined by the exhaust air flow and each air curtain or the shielding space defined through the walls can efficiently guide the smoke in the worktable to the receiving hood to be exhausted, and avoid the smoke from diffusing laterally and leaking, which all fall in the scope claimed in the present invention. If the smoke contains larger particles and cannot be exhausted by the receiving hood, the particles can be guided to adhere to the tabletop of the worktable. When the operator finishes his/her work, the receiving hood is firstly powered off, and the air curtain generators are then powered off, and the smoke adhered to the surface of the worktable can be cleared. Moreover, the air curtain generator of the present invention can improve the capture efficiency of the receiving hood, thus in the operational environment that the receiving hood has insufficient suction force, no additional apparatus for increasing the suction force is required, thus saving the energy. The environment with receiving hood disposed originally can also add air curtain generators to improve the exhausting performance by using the method of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-curtain-assisted exhaust method, using a receiving hood disposed above a worktable to suck and exhaust an air flow, comprising:

disposing a plurality of air curtain generators on an outer edge of the worktable and vertically under the receiving hood to enclose an encircled area in the worktable;

starting each of the air curtain generators to blow out the air curtain having an air blow speed, the air blow speed comprising an air blow direction and an air blow rate, the air blow rate gradually decreasing as the air curtain is far away from the air curtain generator;

blowing each of the air curtain toward the opening of the receiving hood, the encircled area being smaller than the opening of the receiving hood, a vertical component of the air blow direction directing to the opening of the receiving hood; and starting the receiving hood to suck the exhaust air flow, the exhaust rate of the exhaust air flow gradually decreasing as the air flow is far away from the receiving hood, the exhaust rate at the opening of the receiving hood being larger than the air blow rate, the exhaust air flow and each of the air curtain defining a shielding space, wherein the lifting force of the air curtain blown out and the suction force of the receiving hood are in a balanced state in the shielding space to form a dividing height at a zone, such that a shearing stress generated by the air curtain under the dividing height forms an inward and downward vortex, so as to block large particles in a smoke to push the large particles towards the worktable by the inward and downward vortex and push the other smoke towards the air curtain to lift into the receiving hood, thereby improving the capture efficiency of the receiving hood in capturing and exhausting air flow, wherein the step of starting each of the air curtain generators further comprises a step of blowing out the air curtain having an angle from the air curtain generator, wherein the angle falls in 5 to 10 degrees, and is used to determine the air blow direction.

2. The air-curtain-assisted exhaust method as claimed in claim 1, wherein the air blow direction further comprises a horizontal component directing to the interior of the shielding space.

3. The air-curtain-assisted exhaust method as claimed in claim 1, wherein the step of disposing each of the air curtain generators to enclose the worktable further comprises a step of enclosing an encircled area, wherein the ratio between the encircled area in the worktable and that of the opening of the receiving hood is smaller than 0.8.

4. An air-curtain-assisted exhaust method, using a receiving hood disposed above a worktable to suck and exhaust an air flow, wherein the worktable is surrounded by at least one wall, comprising:

disposing a plurality of the air curtain generators on sides of the worktable not surrounded by the wall and vertically under the receiving hood to enclose an encircled area in the worktable together with each of the walls;

starting each of the air curtain generators to blow out the air curtain having an air blow speed, the air blow speed comprising an air blow direction and an air blow rate, the air blow rate gradually decreasing as the air curtain is far away from the air curtain generator;

blowing each of the air curtains toward the opening of the receiving hood, the encircled area being smaller than that of the opening of the receiving hood, a vertical component of the air blow direction directing to the opening of the receiving hood; and starting the receiving hood to suck an exhaust air flow, the exhaust rate of the exhaust air flow gradually decreasing as the air flow is far away from the receiving hood, the exhaust rate at the opening of the receiving hood being larger than the air blow rate, the exhaust air flow and each of the air curtains defining a shielding space;

wherein the lifting force of the air curtain blown out and the suction force of the receiving hood are in a balanced state in the shielding space to form a dividing height at a zone, such that a shearing stress generated by the air curtain under the dividing height forms an inward and downward vortex, so as to block large particles in a smoke to push the large particles towards the worktable by the inward and downward vortex and push the other smoke towards the air curtain to lift into the receiving hood, thereby improving the capture efficiency of the receiving hood in capturing and exhausting air flow, wherein the step of starting each of the air curtain generators further comprises a step of blowing out the air curtain having an angle from the air curtain generator, wherein the angle falls in 5 to 10 degrees, and is used to determine the air blow direction.

5. The air-curtain-assisted exhaust method as claimed in claim 4, wherein the air blow direction further comprises a horizontal component directing to the interior of the shielding space.

6. The air-curtain-assisted exhaust method as claimed in claim 4, wherein the step of disposing each of the air curtain generators to enclose the worktable together with each of the walls further comprises a step of enclosing an encircled area, wherein the ratio between the encircled area in the worktable and the area of the opening of the receiving hood is smaller than 0.8.

* * * * *